United States Patent [19]

Kermode et al.

[11] Patent Number: 4,686,062

[45] Date of Patent: Aug. 11, 1987

[54] DETERGENT COMPOSITION

[75] Inventors: Nigel J. Kermode, Gosforth; Charles D. Bragg, Tynemouth, both of England

[73] Assignee: The Procter & Gamble Company, Cincinnati, Ohio

[21] Appl. No.: 831,380

[22] Filed: Feb. 20, 1986

[30] Foreign Application Priority Data

Feb. 23, 1985 [GB] United Kingdom ..... 8504733

[51] Int. Cl.[4] ..... C11D 7/18; C11D 17/00

[52] U.S. Cl. ..... 252/99; 252/174.24; 252/174.25; 252/DIG. 2; 252/135

[58] Field of Search ..... 252/174.24, 174.25, 252/DIG. 2, 99, 186.25, 186.22, 186.23, 186.1, 186.26–186.29, 135

[56] References Cited

U.S. PATENT DOCUMENTS

| | | | |
|---|---|---|---|
| 4,072,621 | 2/1978 | Rose | 252/89 |
| 4,215,004 | 7/1980 | Borgerding et al. | 252/156 |
| 4,222,995 | 9/1980 | Roebke et al. | 423/329 |
| 4,379,080 | 4/1983 | Murphy | 252/526 |

FOREIGN PATENT DOCUMENTS 2615698 10/1977 Fed. Rep. of Germany .

*Primary Examiner*—Josephine L. Barr

*Attorney, Agent, or Firm*—Robert B. Aylor; Richard C. Witte; Thomas H. O'Flaherty

[57] ABSTRACT

A granular detergent having a phosphorus content of less than 5% comprising:

(a) about 5% to about 50% by weight of a water-insoluble aluminosilicate ion-exchange material and (b) about 0.1% to about 20% of a polycarboxylate polymer comprising:

(i) about 5% to 70% of a $C_3$–$C_{10}$ monoolefinic monocarboxylic acid, (ii) about 5% to 70% of a $C_4$–$C_6$ monoolefinic dicarboxylic acid, and (iii) about 1% to 80% of a nonionic spacer selected from esters of (i) and (ii), $C_{2-6}$ monoolefinic alcohols, and esters of $C_{2-6}$ monoolefinic alcohols.

The compositions display excellent bleach stability, fabric care and detergency performance at low or zero phosphate levels.

13 Claims, No Drawings

DETERGENT COMPOSITION

The present invention relates to detergent compositions. In particular, it relates to built laundry detergent compositions having reduced phosphate levels together with excellent cleaning, whiteness maintenance and stain-removal performance as well as improved bleach stability and fabric-care characteristics.

The role of phosphate detergency builders as adjuncts for organic, water-soluble, synthetic detergents and their value in improving the overall performance of such detergents are well-known. In recent years, however, the use of high levels of phosphate builders, such as the tripolyphosphates, has come under scrutiny because of the suspicion that soluble phosphate species accelerate the eutrophication or ageing process of water bodies. The need exists, therefore for a built laundry detergent composition with zero or reduced phosphate levels but which is comparable to a conventional tripolyphosphate-built composition in overall detergency effectiveness.

The mechanism whereby detergency builders function to improve the detergency action of water-soluble organic detergent compounds is not precisely known, but appears to depend on a combination of such factors as water-softening action, soil suspension and anti-redeposition effects, clay swelling and peptization and pH adjustment. However, present theory does not allow the prediction of which compounds will serve as effective detergency builders.

Sodium aluminosilicates, commonly known as zeolites have been proposed for use as phosphate builder substitutes since they are able to soften water by removing calcium ions (see, for example, BE-A-814,874 and BE-A-813581). Zeolites are unable to duplicate the full range of builder functions demonstrated by phosphates, however.

One way of boosting the overall detergency of zero and low-phosphate formulations is through the use of bleaching auxiliaries such as the inorganic or organic peroxy bleaches and organic bleach activators. Although careful rebalancing of builder and bleach types and levels can indeed provide some improvement in performance, such formulations remain fundamentally weak in a number of areas including bleach stability, fabric damage characteristics, greasy and particulate oil removal especially at low wash temperatures, fabric incrustation and soil suspension.

It has now been discovered that bleaching, cleaning performance and fabric damage characteristics of zeolite-built detergent compositions can be significantly improved by the addition thereto of polycarboxylate polymer having defined proportions of monocarboxylic acid units, dicarboxylic acid units and nonionic spacer units. Moreover, it has been further discovered that certain organic peroxy acid bleach precursors of defined chain length are operable in combination with the zero or low-phosphate builder system to provide cleaning performance which is at least equivalent to a fully phosphate-built formulation across the range of wash temperatures with particularly outstanding performance on greasy and particulate soils at low wash temperatures.

Thus, according to the invention, there is provided a detergent composition comprising:

(a) from about 5% to about 50% by weight of a water-insoluble aluminosilicate cation exchange material, and (b) from about 0.1% to about 20% by weight of a polycarboxylate polymer comprising on a monomer weight basis (i) from about 5% to about 70% of a $C_3$–$C_{10}$ monoolefinic monocarboxylic acid, (ii) from about 5% to about 70% of a $C_4$–$C_6$ monoolefinic dicarboxylic acid, and (iii) from about 1% to about 80% of nonionic spacer which is preferably an ester selected from $C_1$–$C_6$ alkyl and hydroxyalkyl esters of $C_3$–$C_{10}$ monoolefinic monocarboxylic acids, $C_4$–$C_6$ monoolefinic dicarboxylic acids and $C_2$–$C_6$ monoolefinic alcohols, or an alcohol selected from $C_2$–$C_6$ monoolefinic alcohols.

The compositions of the invention contain a zeolite builder and a polycarboxylate polymer comprising three specified monomer units. In addition, the compositions will generally include an organic soap or synthetic detergent surfactant material. Highly preferred compositions also contain a specified bleach system, polycarboxylate homo- or bi-polymers, alkali metal carbonate and alkali metal silicate designed to provide improved detergency and fabric appearance characteristics.

The aluminosilicate cation exchange material comprises from about 3% to about 50%, preferably from about 6% to about 25%, and more preferably from about 7% to about 18% by weight of the detergent composition. The aluminosilicate can be crystalline or amorphous in character, preferred materials having the unit cell formula I $$M_z[(AlO_2)_z(SiO_2)_y]xH_2O \qquad \text{I}$$

wherein M is a calcium-exchange cation, z and y are at least 6; the molar ratio of z to y is from about 1.0 to about 0.5 and x is at least 5, preferably from about 7.5 to about 276, more preferably from about 10 to about 264. The aluminosilicate materials are in hydrated form and are preferably crystalline containing from about 10% to about 28%, more preferably from about 18% to about 22% water.

The aluminosilicate ion exchange materials are further characterized by a particle size diameter of from about 0.1 micron to about 10 microns, preferably from about 0.2 micron to about 4 microns. The term "particle size diameter" herein represents the average particle size diameter of a given ion exchange material as determined by conventional analytical techniques such as, for example, microscopic determination utilizing a scanning electron microscope. The aluminosilicate ion exchange materials herein are usually further characterised by their calcium ion exchange capacity, which is at least about 200 mg. equivalent of $CaCO_3$ water hardness/g of aluminosilicate, calculated on an anhydrous basis, and which generally is in the range of from about 300 mg eq./g to about 352 mg eq./g. The aluminosilicate ion exchange materials herein are still further characterized by their calcium ion exchange rate which is at least about 2 grains $Ca^{++}$/gallon/minute/gram/gallon of aluminosilicate (anhydrous basis), and generally lies within the range of from about 2 grains/gallon/minute/gram/gallon to about 6 grains/gallon/minute/gram/gallon, based on calcium ion hardness. Optimum aluminosilicates for builder purposes exhibit a calcium ion exchange rate of at least about 4 grains/gallon/-minute/gram/gallon.

Aluminosilicate ion exchange materials useful in the practice of this invention are commercially available and can be naturally occurring aluminosilicates or synthetically derived. A method for producing aluminosilicate ion exchange materials is discussed in U.S. Pat. No. 3,985,669. Preferred synthetic crystalline aluminosilicate ion exchange materials useful herein are available under the designations Zeolite A, Zeolite B, Zeolite X, Zeolite HS and mixtures thereof. In an especially preferred embodiment, the crystalline aluminosilicate ion exchange material is Zeolite A and has the formula $$Na_{12}[(AlO_2)_{12}(SiO_2)_{12}]xH_2O$$

wherein x is from about 20 to about 30, especially about 27. Zeolite X of formula $Na_{86}[(AlO_2)_{86}(SiO_2)_{106}]0.276H_2O$ is also suitable, as well as Zeolite HS of formula $Na_6[(AlO_2)_6(SiO_2)_6]7.5H_2O$).

The compositions of the invention are either essentially free of phosphate or contain a low level of phosphate builder such that the total phosphorus level is less than about 5% by weight, preferably less than about 4% by weight, more preferably less than about 3% by weight. Phosphate, when present, will generally comprise from about 2% to about 18%, preferably from about 5% to about 16%, more preferably from about 8% to about 14% by weight of composition. The phosphate builder is preferably selected from sodium and potassium tripolyphosphates and hydrates thereof but is also preferably substantially anhydrous or partly hydrated (i.e. to no more than about 90%, preferably no more than about 60% of its hydration capacity). Phosphate builder content is measured on an anhydrous basis however. In preferred embodiments, the phosphate builder comprises less than about 12% thereof, preferably less than about 8% thereof of pyrophosphates. Highly preferred is a phosphate builder system which is admixed in dry crystalline form with the remainder of the detergent composition.

The polycarboxylate polymer component of the present compositions comprises three essential monomer units, a $C_3$–$C_{10}$ monoolefinic monocarboxylic acid (M1), a $C_4$–$C_6$ monoolefinic dicarboxylic acid (M2) and a nonionic spacer unit (M3). On a monomer weight basis, M1 generally comprises from about 5% to about 70% of the polymer, M2 generally comprises from about 5% to about 70% of the polymer, and M3 generally comprises from about 1% to about 80% of the polymer. The monocarboxylic acid is preferably selected from acrylic acid, methacrylic acid and mixtures thereof; the dicarboxylic acid is preferably selected from maleic acid, itaconic acid and mixtures thereof; and the nonionic spacer is preferably an ester selected from $C_1$–$C_6$ alkyl and hydroxyalkyl esters of $C_3$–$C_{10}$ monoolefinic monocarboxylic acids, $C_4$–$C_6$ monoolefinic dicarboxylic acids and $C_2$–$C_6$ monoolefinic alcohols, or an alcohol selected from $C_2$–$C_6$ monoolefinic alcohols.

There are two principle types of polycarboxylate copolymers suitable for use herein. In a first type, the polymer comprises on a nonionic weight basis (i) from about 10% to about 45%, preferably from about 20% to about 40%, of monoolefinic monocarboxylic acid, (ii) from about 10% to about 45%, preferably from about 20% to about 40%, of monoolefinic dicarboxylic acid, and (iii) from about 10% to about 50%, preferably from about 20% to about 45%, of nonionic spacer selected from $C_1$–$C_6$ alkyl and hydroxyalkyl esters of $C_3$–$C_{10}$ monoolefinic monocarboxylic acids and $C_4$–$C_6$ monoolefinic dicarboxylic acids.

In this class of copolymer, the nonionic spacer is preferably selected from $C_2$–$C_6$ hydroxyalkyl esters of the specified mono- and di-carboxylic acids, especially hydroxypropyl(meth)acrylate, hydroxyethyl(meth)acrylate, or butanediol(meth)acrylate.

A second type of copolymer preferred for use herein comprises on a monomer weight basis (i) from about 20% to about 60%, preferably from about 30% to about 50% of monoolefinic monocarboxylic acid, (ii) from about 20% to about 60%, preferably from about 30% to about 50% of monoolefinic dicarboxylic acid, and (iii) from about 1% to about 40%, preferably from about 2% to about 25% of nonionic spacer selected from $C_2$–$C_6$ monoolefinic alcohols and $C_1$–$C_6$ alkyl and hydroxyalkyl esters thereof.

In this class of copolymer, the nonionic spacer is preferably vinyl acetate or vinyl alcohol.

The above polycarboxylate copolymers are incorporated in the compositions of the invention at a level of from about 0.1% to about 20%, preferably from about 0.5% to about 10%, more preferably from about 1% to about 5% by weight of composition.

The polycarboxylate polymers suitable for use herein generally have a K value of from about 8 to about 100, preferably from about 20 to about 80, more preferably from about 20 to about 60. K value ($=10^3k$) is described by H. Fikentscher, Cellulosechemie, 14, 58 to 64 and 71 to 74 (1932) and is measured herein on the sodium salt of the polymer at 2% by weight in water at 25° C.

The compositions of the invention can also be supplemented by other builders such as nitrilotriacetic acid and salts thereof in levels generally from about 1% to about 8%, preferably from about 3% to 7% by weight of composition.

The detergent compositions of the invention can also include a bleach system comprising an inorganic or organic peroxy bleaching agent, a heavy metal scavenging agent and in preferred compositions, an organic peroxy acid bleach precursor.

Suitable inorganic peroxygen bleaches include sodium perborate mono- and tetrahydrate, sodium percarbonate, sodium persilicate and urea-hydrogen peroxide addition products and the clathrate $4Na_2SO_4{:}2H_2O_2{:}1NaCl$. Suitable organic bleaches include peroxylauric acid, peroxyoctanoic acid, peroxynonanoic acid, peroxydecanoic acid, diperoxydodecanedioic acid, diperoxyazelaic acid, mono- and diperoxyphthalic acid and mono- and diperoxyisophthalic acid. The bleaching agent is generally present in the compositions of the invention at a level of from about 5% to about 35% preferably from about 10% to about 25% by weight.

The heavy metal scavenging agent is preferably a water-soluble chelating agent. Preferred are aminopolyacids having four or more acidic protons per molecule. Suitable chelating agents include aminocarboxylate chelating agents such as ethylenediaminetetraacetic acid (EDTA), hydroxyethylethylenediaminetriacetic acid (HEEDTA), dihydroxyethylethylenediaminediacetic acid (DHEEDDA), diethylenetriaminepentaacetic acid (DETPA), 1,2-diaminocyclohexane-N,N,N',N'-tetraacetic acid (DCTA) and water-soluble salts thereof, and aminopolyphosphonate chelating agents such as ethylenediaminetetra(methylenephosphonic acid) (EDTMP), diethylenetriaminepenta(methylenephosphonic acid) (DETPMP), nitrilotri(methylenephosphonic acid) (NTMP), hexamethylenediaminetetramethylenephosphonic acid (HMTPM) and water-soluble salts thereof. The above water-soluble sequestrants are generally at a level of from about 0.05% to about 4% preferably from about 0.1% to about 1.0% by weight.

The heavy metal scavenging agent herein can also be represented by water-soluble smectite-type clays selected from saponites, hectorites and sodium and calcium montmorillorites (sodium and calcium here designating the principal inorganic cation of the clay).

While any of the above smectite-type clays can be incorporated in the compositions of the invention, particularly preferred smectite-type clays have ion-exchange capacities of at least 50 meq/100 g clay, more preferably at least 70 meq/100 g (measured, for instance, as described in "The Chemistry and Physics of Clays", p.p. 264–265, Interscience (1979)). Especially preferred materials are as follows:

Sodium Montmorillonite
- Brock
- Volclay BC
- Gelwhite GP
- Thixo-Jel
- Ben-A-Gel
- Imvite Sodium Hectorite
- Veegum F
- Laponite SP Sodium Saponite
- Barasym NAS 100

Calcium Montmorillonite
- Soft Clark
- Gelwhite L

Lithium Hectorite
- Barasym LIH 200

When present, the above clays are generally added at a level of from about 1% to about 20%, more preferably from about 2% to about 10% by weight of composition. Such clays also provide a fabric softening benefit to the compositions.

Another suitable heavy metal scavenging agent is water-insoluble, preferably colloidal magnesium silicate or a water-soluble magnesium salt forming magnesium silicate in the aqueous slurry crutcher mix prior to spray-drying. The magnesium silicate or salt is generally added at a level in the range from about 0.015% to about 0.2%, preferably from about 0.03% to about 0.15%, more preferably from about 0.05% to about 0.12% by weight (magnesium basis). Suitable magnesium salts include magnesium sulfate, magnesium sulfate heptahydrate, magnesium chloride and magnesium chloride hexahydrate.

The compositions of the invention preferably also contain an organic peroxy acid bleach precursor at a level of from about 0.5% to about 10%, preferably from about 1% to about 6% by weight. Suitable bleach precursors are disclosed in No. UK-A-2040983, and include for example, the peracetic acid bleach precursors such as tetraacetylethylenediamine, tetraacetylmethylenediamine, tetraacetylhexylenediamine, sodium p-acetoxybenzene sulphonate, tetraacetylglycouril, pentaacetylglucose, octaacetyllactose, and methyl o-acetoxy benzoate. Highly preferred bleach precursors, however, have the general formula II

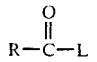

IV wherein R is an alkyl group containing from 6 to 12 carbon atoms wherein the longest linear alkyl chain extending from and including the carboxyl carbon contains from 5 to 10 carbon atoms and L is a leaving group, the conjugate acid of which has a $pK_a$ in the range from 6 to 13.

The alkyl group, R, can be either linear or branched and, in preferred embodiments, it contains from 7 to 9 carbon atoms. Preferred leaving groups L have a $pK_a$ in the range from about 7 to about 11, more preferably from about 8 to about 10. Examples of leaving groups are those having the formula

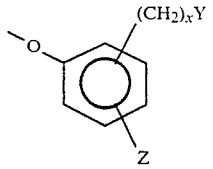

(a)

and

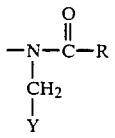

(b)

wherein Z is H, $R^1$ or halogen, $R^1$ is an alkyl group having from 1 to 4 carbon atoms, x is 0 or an integer of from 1 to 4 and Y is selected from $SO_3M$, $OSO_3M$, $CO_2M$, $N^+(R^1)_3Q^-$ and $N^+(R^1)_2—O^-$ wherein M is H, alkali metal, alkaline earth metal, ammonium or substituted ammonium, and Q is halide or methosulfate.

The preferred leaving group L has the formula (a) in which Z is H, x is 0 and Y is sulfonate, carboxylate or dimethylamine oxide radical. Highly preferred materials are sodium 3,5,5,-trimethylhexanoyloxybenzene sulfonate, sodium 3,5,5-trimethylhexanoyloxybenzoate, sodium 2-ethylhexanoyl oxybenzenesulfonate, sodium nonanoyl oxybenzene sulfonate and sodium octanoyl oxybenzenesulfonate, the acyloxy group in each instance preferably being p-substituted.

The bleach activator herein will normally be added in the form of particles comprising finely-divided bleach activator and a binder. The binder is generally selected from nonionic surfactants such as the ethoxylated tallow alcohols, polyethylene glycols, anionic surfactants, film forming polymers, fatty acids and mixtures thereof. Highly preferred are nonionic surfactant binders, the bleach activator being admixed with the binder and extruded in the form of elongated particles through a radial extruder as described in European Patent Application No. 62523. Alternatively, the bleach activator particles can be prepared by spray drying as described in British Patent Application No. 8422158.

The detergent compositions herein generally contain from about 5% to about 60%, preferably from about 8% to about 30% by weight of an organic surfactant selected from anionic, nonionic, zwitterionic, ampholytic and cationic surfactants, and mixtures thereof. Surfactants useful herein are listed in U.S. Pat. No. 4,222,905 and U.S. Pat. No. 4,239,659.

The anionic surfactant can be any one or more of the materials used conventionally in laundry detergents. Suitable synthetic anionic surfactants are water-soluble salts of alkyl benzene sulphonates, alkyl sulphates, alkyl polyethoxy ether sulphates, paraffin sulphonates, alpha-olefin sulphonates, alpha-sulfo-carboxylates and their esters, alkyl glyceryl ether sulphonates, fatty acid monoglyceride sulphates and sulphonates, alkyl phenol polyethoxy ether sulphates, 2-acyloxy alkane-1-sulphonate, and beta-alkyloxy alkane sulphonate.

A particularly suitable class of anionic surfactants includes water-soluble salts, particularly the alkali metal, ammonium and alkanolammonium salts or organic sulphuric reaction products having in their molecular structure an alkyl or alkaryl group containing from about 8 to about 22, especially from about 10 to about 20 carbon atoms and a sulphonic acid or sulphuric acid ester group. (Included in the term "alkyl" is the alkyl portion of acyl groups). Examples of this group of synthetic detergents which form part of the detergent compositions of the present invention are the sodium and potassium alkyl sulphates, especially those obtained by sulphating the higher alcohols ($C_{8-18}$) carbon atoms produced by reducing the glycerides of tallow or coconut oil and sodium and potassium alkyl benzene sulphonates, in which the alkyl group contains from about 9 to about 15, especially about 11 to about 13, carbon atoms, in straight chain or branched chain configuration, e.g. those of the type described in U.S. Pat. No. 2,220,099 and U.S. Pat. No. 2,477,383 and those prepared from alkylbenzenes obtained by alkylation with straight chain chloroparaffins (using aluminium trichloride catalysis) or straight chain olefins (using hydrogen fluoride catalysis). Especially valuable are linear straight chain alkyl benzene sulphonates in which the average of the alkyl group is about 11.8 carbon atoms, abbreviated as $C_{11.8}$ LAS, and $C_{12}$–$C_{15}$ methyl branched alkyl sulphates.

Other anionic detergent compounds herein include the sodium $C_{10-18}$ alkyl glyceryl ether sulphonates, especially those ethers of higher alcohols derived from tallow and coconut oil; sodium coconut oil fatty acid monoglyceride sulphonates and sulphates; and sodium or potassium salts of alkyl phenol ethylene oxide ether sulphate containing about 1 to about 10 units of ethylene oxide per molecule and wherein the alkyl groups contain about 8 to about 12 carbon atoms.

Other useful anionic detergent compounds herein include the water-soluble salts or esters of alpha-sulphonated fatty acids containing from about 6 to 20 carbon atoms in the fatty acid group and from about 1 to 10 carbon atoms in the ester group; water-soluble salts of 2-acyloxy-alkane-1-sulphonic acids containing from about 2 to 9 carbon atoms in the acyl group and from about 9 to about 23 carbon atoms in the alkane moiety; alkyl ether sulphates containing from about 10 to 18, especially about 12 to 16, carbon atoms in the alkyl group and from about 1 to 12, especially 1 to 6, more especially 1 to 4 moles of ethylene oxide; water-soluble salts of olefin sulphonates containing from about 12 to 24, preferably aout 14 to 16, carbon atoms, especially those made by reaction with sulphur trioxide followed by neutralization under conditions such that any sultones present are hydrolysed to the corresponding hydroxy alkane sulphonates; water-soluble salts of paraffin sulphonates containing from about 8 to 24, especially 14 to 18 carbon atoms, and beta-alkyloxy alkane sulphonates containing from about 1 to 3 carbon atoms in the alkyl group and from about 8 to 20 carbon atoms in the alkane moiety.

The alkane chains of the foregoing non-soap anionic surfactants can be derived from natural sources such as coconut oil or tallow, or can be made synthetically as for example using the Ziegler or Oxo processes. Water solubility can be achieved by using alkali metal, ammonium or alkanolammonium cations; sodium is preferred. Suitable fatty acid soaps can be selected from the ordinary alkali metal (sodium, potassium), ammonium, and alkylolammonium salts of higher fatty acids containing from about 8 to about 24, preferably from about 10 to about 22 and especially from about 16 to about 22 carbon atoms in the alkyl chain. Suitable fatty acids can be obtained from natural sources such as, for instance, from soybean oil, castor oil, tallow, whale and fish oils, grease, lard and mixtures thereof). The fatty acids also can be synthetically prepared (e.g., by the oxidation of petroleum, or by hydrogenation of carbon monoxide by the Fischer-Tropsch process). Resin acids are suitable such as rosin and those resin acids in tall oil. Napthenic acids are also suitable. Sodium and potassium soaps can be made by direct saponification of the fats and oils or by the neutralization of the free fatty acids which are prepared in a separate manufacturing process. Particularly useful are the sodium and potassium salts of the mixtures of fatty acids derived from tallow and hydrogenated fish oil.

Mixtures of anionic surfactants are particularly suitable herein, especially mixtures of sulfonate and sulfate surfactants in a weight ratio of from about 5:1 to about 1:5, preferably from about 5:1 to about 1:1, more preferably from about 5:1 to about 1.5:1. Especially preferred is a mixture of an alkyl benzene sulfonate having from 9 to 15, especially 11 to 13 carbon atoms in the alkyl radical, the cation being an alkali metal, preferably sodium; and either an alkyl sulfate having from 10 to 20, preferably 12 to 18 carbon atoms in the alkyl radical or an ethoxy sulfate having from 10 to 20, preferably 10 to 16 carbon atoms in the alkyl radical and an average degree of ethoxylation of 1 to 6, having an alkali metal cation, preferably sodium.

The nonionic surfactants useful in the present invention are condensates of ethylene oxide with a hydrophobic moiety to provide a surfactant having an average hydrophilic-lipophilic balance (HLB) in the range from about 8 to 17, preferably from about 9.5 to 13.5, more preferably from about 10 to about 12.5. The hydrophobic moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Examples of suitable nonionic surfactants include:

1. The polyethylene oxide condensates of alkyl phenol, e.g. the condensation products of alkyl phenols having an alkyl group containing from 6 to 12 carbon atoms in either a straight chain or branched chain configuration, with ethylene oxide, the said ethylene oxide being present in amounts equal to 3 to 30, preferably 5 to 14 moles of ethylene oxide per mole of alkyl phenol. The alkyl substituent in such compounds may be derived, for example, from polymerised propylene, diisobutylene, octene and nonene. Other examples include dodecylphenol condensed with 9 moles of ethylene oxide per mole of phenol; dinonylphenol condensed with 11 moles of ethylene oxide per mole of phenol; nonylphenol and di-isooctylphenol condensed with 13 moles ethylene oxide.

2. The condensation product of primary or secondary aliphatic alcohols having from 8 to 24 carbon atoms, in either straight chain or branched chain configuration, with from 2 to about 40 moles, preferably 2 to about 9 moles of ethylene oxide per mole of alcohol. Preferably, the aliphatic alcohol comprises between 9 and 18 carbon atoms and is ethoxylated with between 2 and 9, desirably between 3 and 8 moles of ethylene oxide per mole of aliphatic alcohol. The preferred surfactants are prepared from primary alcohols which are either linear (such as those derived from natural fats or, prepared by the Ziegler process from ethylene, e.g. myristyl, cetyl, stearyl alcohols), or partly branched such as the Lutensols, Dobanols and Neodols which have about 25% 2-methyl branching (Lutensol being a Trade Name of BASF, Dobanol and Neodol being Trade Names of Shell), or Synperonics, which are understood to have about 50% 2-methyl branching (Synperonic is a Trade Name of I.C.I.) or the primary alcohols having more than 50% branched chain structure sold under the Trade Name Lial by Liquichimica. Specific examples of nonionic surfactants falling within the scope of the invention include Dobanol 45-4, Dobanol 45-7, Dobanol 45-9, Dobanol 91-2.5, Dobanol 91-3, Dobanol 91-4, Dobanol 91-6, Dobanol 91-8, Dobanol 23-6.5, Synperonic 6, Synperonic 14, the condensation products of coconut alcohol with an average of between 5 and 12 moles of ethylene oxide per mole of alcohol, the coconut alkyl portion having from 10 to 14 carbon atoms, and the condensation products of tallow alcohol with an average of between 7 and 12 moles of ethylene oxide per mole of alcohol, the tallow portion comprising essentially between 16 and 22 carbon atoms. Secondary linear alkyl ethoxylates are also suitable in the present compositions, especially those ethoxylates of the Tergitol series having from about 9 to 15 carbon atoms in the alkyl group and up to about 11, especially from about 3 to 9, ethoxy residues per molecule.

The compounds formed by condensing ethylene oxide with a hydrophobic base formed by the condensation of propylene oxide with propylene glycol. The molecular weight of the hydrophobic portion generally falls in the range of about 1500 to 1800. Such synthetic nonionic detergents are available on the market under the Trade Name of "Pluronic" supplied by Wyandotte Chemicals Corporation.

Especially preferred nonionic surfactants for use herein are the $C_9$–$C_{15}$ primary alcohol ethoxylates containing 3–8 moles of ethylene oxide per mole of alcohol, particularly the $C_{12}$–$C_{15}$ primary alcohols containing 6–8 moles of ethylene oxide per mole of alcohol.

Cationic surfactants suitable for use herein include quaternary ammonium surfactants and surfactants of a semi-polar nature, for example amine oxides.

Suitable surfactants of the amine oxide class have the general formula V

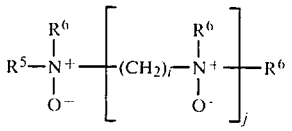

V wherein $R^5$ is a linear or branched alkyl or alkenyl group having 8 to 20 carbon atoms, each $R^6$ is independently selected from $C_{1-4}$ alkyl and $-(C_nH_{2n}O)_mH$ where i is an integer from 1 to 6, j is 0 or 1, n is 2 or 3 and m is from 1 to 7, the sum total of $C_nH_{2n}O$ groups in a molecule being no more than 7.

In a preferred embodiment $R^5$ has from 10 to 14 carbon atoms and each $R^6$ is independently selected from methyl and $-(C_nH_{2n}O)_mH$ wherein m is from 1 to 3 and the sum total of $C_nH_{2n}O$ groups in a molecule is no more than 5, preferably no more than 3. In a highly preferred embodiment, j is 0 and each $R^6$ is methyl, and $R^5$ is $C_{12}$–$C_{14}$ alkyl.

Another suitable class of amine oxide species is represented by bis-amine oxides having the following substituents.

j: 1

$R^5$: tallow $C_{16}$–$C_{18}$ alkyl; palmityl; oleyl; stearyl $R_6$: hydroxyethyl i: 2 or 3

A specific example of this preferred class of bis-amine oxides is: N-hydrogenated $C_{16}$–$C_{18}$ tallow alkyl-N,N',N'tri-(2-hydroxyethyl)-propylene-1,3-diamine oxide.

Suitable quaternary ammonium surfactants for use in the present composition can be defined by the general formula VI:

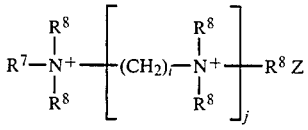

VI wherein $R^7$ is a linear or branched alkyl, alkenyl or alkaryl group having 8 to 16 carbon atoms and each $R^8$ is independently selected from $C_{1-4}$ alkyl, $C_{1-4}$ alkaryl and $-(C_nH_{2n}O)_m$ wherein i is an integer from 1 to 6, j is 0 or 1, n is 2 or 3 and m is from 1 to 7, the sum total of $C_nH_{2n}O$ groups in a molecule being no more than 7, and wherein Z represents counteranion in number to give electrical neutrality.

In a preferred embodiment, $R^7$ has from 10 to 14 carbon atoms and each $R^8$ is independently selected from methyl and $(C_nH_{2n}O)_mH$ wherein m is from 1 to 3 and the sum total of $C_nH_{2n}O$ groups in a molecule is no more than 5, preferably no more than 3. In a highly preferred embodiment j is 0, $R^8$ is selected from methyl, hydroxyethyl and hydroxypropyl and $R^7$ is $C_{12}$–$C_{14}$ alkyl. Particularly preferred surfactants of this class include $C_{12}$ alkyl trimethylammonium salts, $C_{14}$ alkyltrimethylammonium salts, coconutalkyltrimethylammonium salts, coconutalkyldimethyl-hydroxyethylammonium salts, coconutalkyldimethylhydroxypropylammonium salts, and $C_{12}$ alkyldihydroxyethylmethyl ammonium salts.

Another group of useful cationic compounds are the diammonium salts of formula VI in which j is 1, $R^7$ is $C_{12}$–$C_{14}$ alkyl, each $R^8$ is methyl, hydroxyethyl or hydroxypropyl and i is 2 or 3. In a particularly preferred surfactant of this type, $R^7$ is coconut alkyl, $R^8$ is methyl and i is 3.

In highly preferred compositions, the builder system herein is supplemented by three additional components, homo- or bi-polycarboxylate polymers, alkali metal carbonates and alkali metal silicates.

The homo- or bi-polycarboxylate polymers herein comprise on a monomer weight basis from about 25% to 100%, preferably from about 50% to 100% of $C_3$–$C_{10}$ monoolefinic monocarboxylic acid units and/or $C_4$–$C_6$ monoolefinic dicarboxylic acid units. The polymers are preferably selected from bi-polymeric polycarboxylic acids and their salts derived from maleic acid or itaconic acid as a first monomer and ethylene, methylvinyl ether, acrylic acid or methacrylic acid as a second monomer, the bi-polymer having a weight-average molecular weight of at least about 12,000, preferably at least about 30,000; homopolyacrylates and homopolymethacrylates having a weight-average molecular weight of from about 1000 to about 20,000, preferably from about 1000 to about 10,000; and mixtures thereof. Mixtures are highly preferred in the context of providing excellent bleach stability, detergency and anti-incrustation performance. Suitable mixtures have a bi-polymer:homo-polymer ratio of from about 1:2 to about 5:1, preferably from about 1:1 to about 5:1, more preferably about 1:1 to 2:1. The total level of homo- and bi-polycarboxylate polymer in final product is preferably from about 0.5% to about 5%, more preferably from about 2% to about 4%.

Weight-average polymer molecular weights can be determined herein by light scattering or by gel permeation chromotography using Waters $\mu$ Porasil (RTM) GPC 60 $A^2$ and $\mu$ Bondagel (RTM) E-125, E-500 and E-1000 in series, temperature-controlled columns at 40° C. against sodium polystyrene sulphonate polymer standards, available from Polymer Laboratories Ltd., Shropshire, UK, the polymer standards being calibrated as their sodium salts, and the eluant being 0.15M sodium dihydrogen phosphate and 0.02M tetramethyl ammonium hydroxide at pH 7.0 in 80/20 water/acetonitrile.

Alkali metal carbonate is important herein for providing the appropriate in-use solution pH for optimum detergency (from about pH 10 to pH 11, preferably from about pH 10.4 to about pH 10.6, measured as 1% solution). Generally, the compositions of the invention include from about 5% to about 30%, preferably from about 10% to about 25% alkali metal carbonate (anhydrous basis). Alkali metal silicate is preferably included in the compositions of the invention at a level in the range from about 1% to about 10%, more preferably from about 1.5% to about 4%. At lower levels, bleaching performance is found to be increasingly degraded; at higher levels, on the other hand, aluminosilicate performance and fabric appearance is increasingly effected by aluminosilicate particle aggregation.

The compositions of the invention can be supplemented by all manner of detergent and laundering components, inclusive of suds suppressors, enzymes, fluorescers, photoactivators, bleach catalysts, soil suspending agents, anti-caking agents, pigments, perfumes, fabric conditioning agents etc.

Suds suppressors are represented by materials of the silicone, wax, vegetable and hydrocarbon oil and phosphate ester varieties. Suitable silicone suds controlling agents include polydimethylsiloxanes having a molecular weight in the range from about 200 to about 200,000 and a kinematic viscosity in the range from about 20 to about 2,000,000 $mm^2/s$, preferably from about 3000 to about 30,000 $mm^2/s$, and mixtures of siloxanes and hydrophobic silanated (preferably trimethylsilanated) silica having a particle size in the range from about 10 millimicrons to about 20 millimicrons and a specific surface area above about 50 $m^2/g$. Suitable waxes include microcrystalline waxes having a melting point in the range from about 65° C. to about 100° C., a molecular weight in the range from about 400–1000, and a penetration value of at least 6, measured at 77° F. by ASTM-D1321, and also paraffin waxes, synthetic waxes and natural waxes. Suitable phosphate esters include mono- and/or di-$C_{16}$–$C_{22}$ alkyl or alkenyl phosphate esters, and the corresponding mono- and/or di alkyl or alkenyl ether phosphates containing up to 6 ethoxy groups per molecule.

Enzymes suitable for use herein include those discussed in U.S. Pat. No. 3,519,570 and U.S. Pat. No. 3,533,139 to McCarty and McCarty et al issued July 7, 1970 and Jan. 5, 1971, respectively. Suitable fluorescers include Blankophor MBBH (Bayer AG) and Tinopal CBS and EMS (Ciba Geigy). Photoactivators are discussed in EP-A-57088, highly preferred materials being zinc phthalocyanine tri- and tetra-sulfonates. Suitable fabric conditioning agents include di-$C_{12}$–$C_{24}$ alkyl or alkenyl amines and ammonium and quaternary ammonium salts. Suitable bleach catalysts are discussed in European Patent Application No. 72166 and European Patent Application No. 84302774.9.

Antiredeposition and soil suspension agents suitable herein include cellulose derivatives such as methylcellulose, carboxymethylcellulose and hydroxyethylcellulose.

The compositions of the invention are preferably prepared by spray-drying an aqueous slurry comprising the aluminosilicate and, where present, alkali metal silicate and anionic surfactant. Tripolyphosphate builder and carbonate, where present, can also be included in the slurry for spray-drying but preferably they are separately dry-mixed with the spray-dried base granules. The aqueous slurry is mixed at a temperature in the range from about 45°–90° C. and the water-content of the slurry adjusted to a range of about 25% to about 50%. Spray drying is undertaken with a drying gas inlet temperature of from about 250°–390° C., preferably about 275°–350° C., providing a final moisture content in the range of from about 8% to 14% by weight.

In the examples which follow, the abbreviations used have the following designations:

| | |
|---|---|
| $C_{12}$LAS | Sodium linear $C_{12}$ benzene sulphonate |
| TAS | Sodium tallow alcohol sulphate |
| $C_{12/14}$AS | $C_{12/14}$ alcohol sulphate, sodium salt |
| $TAE_n$ | Hardened tallow alcohol ethoxylated with n moles of ethylene oxide per mole of alcohol |
| $C_{12}$TMAB | $C_{12}$ alkyl trimethyl ammonium bromide |
| Dobanol 45E7 | A $C_{14-15}$ primary alcohol condensed with 7 moles of ethylene oxide. |
| TAED | Tetraacetyl ethylene diamine |
| PAG | Penta acetyl glucose |
| AOBS | Sodium p-acetoxy benzene sulphonate |
| NOBS | Sodium nonanoyl oxybenzenesulphonate |
| INOBS | Sodium 3,5,5 trimethyl hexanoyl oxybenzene sulphonate |
| INOBA | Sodium 3,5,5 trimethyl hexanoyl oxybenzene carboxylate |
| EHOBS | Sodium 2-ethyl hexanoyl oxybenzene sulphonate |
| Silicate | Sodium silicate having an |

-continued

| | |
|---|---|
| | $SiO_2$:$Na_2O$ ratio of 1:6 |
| Sulphate | Anhydrous sodium sulphate |
| Carbonate | Anhydrous sodium carbonate |
| CMC | Sodium carboxymethyl cellulose |
| Silicone | Comprising 0.14 parts by weight of an 85:15 by weight mixture of silanated silica and silicone, granulated with 1.3 parts of sodium tripolyphosphate, and 0.56 parts of tallow alcohol condensed with 25 molar proportions of ethylene oxide |
| PC1 | Copolymer of 3:7 maleic/acrylic acid, average molecular weight about 70,000, as sodium salt |
| PC2 | Polyacrylic acid, average molecular weight about 4,500, as sodium salt |
| PC3 | Copolymer of acrylic acid/maleic acid/hydroxypropylacrylate (30/30/40) - K value 47.3 |
| PC4 | Copolymer of acrylic acid/maleic acid/vinyl alcohol (45/45/10) - K value 59 |
| PC5 | Copolymer of acrylic acid/maleic acid/hydroxypropylacrylate (40/40/20) - K value 43.1 |
| Phosphate | Anhydrous pentasodium tripolyphosphate (ortho/pyro content = 3%) |
| Perborate | Sodium perborate tetrahydrate of nominal formula $NaBO_2.3H_2O.H_2O_2$ |
| Enzyme | Protease |
| EDTA | Sodium ethylene diamine tetra acetate |
| Brightener | Disodium 4,4'-bis(2-morpholino-4-anilino-s-triazin-6-ylamino) stilbene-2:2'-disulphonate |
| DETPMP | Diethylene triamine penta(methylene phosphonic acid), marketed by Monsanto under the Trade name Dequest 2060 |
| EDTMP | Ethylenediamine tetra (methylene phosphonic acid), marketed by Monsanto, under the Trade name Dequest 2041 |
| Clay | Sodium montmorillonite |

EXAMPLES I TO VIII

Granular detergent compositions are prepared as follows. A base powder composition is first prepared by mixing all components except Dobanol 45E7, bleach, bleach activator, enzyme, suds suppressor, phosphate and carbonate in a crutcher as an aqueous slurry at a temperature of about 55° C. and containing about 35% water. The slurry is then spray dried at a gas inlet temperature of about 330° C. to form base powder granules. The bleach activator, where present, is then admixed with $TAE_{25}$ as binder and extruded in the form of elongate particles through a radial extruder as described in European Patent Application No. 62523. The bleach activator noodles, bleach, enzyme, suds suppressor, phosphate and carbonate are they dry-mixed with the base powder composition and finally Dobanol 45E7 is sprayed into the final mixture.

| | EXAMPLES | | | | | | | |
|---|---|---|---|---|---|---|---|---|
| | I | II | III | IV | V | VI | VII | VIII |
| $C_{12}$LAS | 5 | 9 | 8 | 8 | 4 | 4 | 3 | 5 |
| TAS | — | 3 | 3 | — | 4 | — | — | — |
| $C_{12/14}$AS | 5 | — | — | 8 | — | 4 | 1 | 4 |
| $TAE_{25}$ | 0.5 | 0.5 | 0.8 | 0.3 | 0.8 | 0.8 | 0.2 | — |
| $TAE_{11}$ | — | 1 | — | — | 0.6 | — | — | 1 |
| Dobanol 45E7 | 2 | — | 4 | 2 | 4 | 8 | 10 | 5 |
| $C_{12}$TMAB | 2 | — | — | — | — | 2 | 2 | — |
| NOBS | 3 | — | — | — | — | — | — | — |
| INOBS | — | 3 | — | — | — | — | — | — |
| INOBA | — | — | 5 | — | — | — | — | — |
| EHOBS | — | — | — | 2 | — | — | — | — |

-continued

| | EXAMPLES | | | | | | | |
|---|---|---|---|---|---|---|---|---|
| | I | II | III | IV | V | VI | VII | VIII |
| TAED | — | 1 | — | — | 3 | — | — | — |
| PAG | — | — | — | — | — | 4 | — | — |
| AOBS | — | — | — | — | — | — | 1 | — |
| Perborate | 25 | 20 | 10 | 24 | 20 | 18 | 24 | 28 |
| EDTMP | — | 0.3 | 0.3 | — | — | — | 1.0 | — |
| DETPMP | 0.4 | — | — | — | 0.5 | — | — | 0.1 |
| EDTA | 0.2 | 0.2 | 0.2 | 0.1 | 0.3 | 0.1 | 0.2 | 0.3 |
| Clay | — | — | — | 6 | — | 4 | — | — |
| Magnesium (ppm) | — | 1000 | 750 | — | — | — | — | 800 |
| PC1 | — | 1 | 2 | — | — | 2 | 2 | — |
| PC2 | 1 | — | — | 2 | — | — | — | — |
| PC3 | — | 3 | — | — | 2 | 4 | 1 | 1 |
| PC4 | 5 | — | 2 | — | — | — | — | 4 |
| PC5 | — | — | — | 4 | 2 | — | — | — |
| Zeolite A* | 18 | 15 | 18 | 16 | 13 | 16 | 12 | 22 |
| Phosphate | — | 10 | 9 | — | 7 | — | 9 | — |
| Soap | 1 | — | — | 2 | — | 3 | 3 | 2 |
| Carbonate | 8 | 18 | 10 | 8 | 5 | 13 | 6 | 11 |
| Silicate | 1.5 | 2 | 2 | 1 | 7 | 2 | 2.5 | 1.5 |
| NTA | — | — | 1 | 4 | — | 2 | — | — |
| Silicone | 0.2 | 0.2 | 0.3 | 0.2 | 0.2 | 0.4 | 0.5 | 0.2 |
| Enzyme | 0.1 | 0.5 | 0.4 | 0.3 | 0.4 | 0.5 | 0.7 | 1.0 |
| Brightener | 0.2 | 0.2 | 0.2 | 0.2 | 0.2 | 0.2 | 0.2 | 0.2 |
| Sulphate, Moisture & Miscellaneous | To 100 | | | | | | | |

*Zeolite A of 4 A pore size.

The above compositions are zero and low phosphate detergent compositions displaying excellent bleach stability, fabric care and detergency performance across the range of wash temperatures with particularly outstanding performance in the case of Examples I to IV on greasy and particulate soils at low wash temperatures.

What is claimed is:

1. A granular detergent composition having a phosphorus content of less than 5% comprising:

(a) from about 5% to about 50% by weight of a water-insoluble aluminosilicate cation exchange material, and (b) from about 0.1% to about 20% by weight of a polycarboxylate polymer comprising on a monomer weight basis (i) from about 5% to about 70% of a $C_3$–$C_{10}$ monoolefinic monocarboxylic acid, (ii) from about 5% to about 70% of a $C_4$–$C_6$ monoolefinic dicarboxylic acid, and (iii) from about 1% to about 80% of nonionic spacer which is an ester selected from $C_1$–$C_6$ alkyl and hydroxyalkyl esters of $C_3$–$C_{10}$ monoolefinic monocarboxylic acids, $C_4$–$C_6$ monoolefinic dicarboxylic acids and $C_2$–$C_6$ monoolefinic alcohols, or an alcohol selected from $C_2$–$C_6$ monoolefinic alcohols.

2. A composition according to claim 1 wherein the polymer comprises on a monomer weight basis (i) from about 10% to about 45% of monoolefinic monocarboxylic acid, (ii) from about 10% to about 45% of monoolefinic dicarboxylic acid, and (iii) from about 10% to about 50% of nonionic spacer selected from $C_1$–$C_6$ alkyl and hydroxyalkyl esters of $C_3$–$C_{10}$ monoolefinic monocarboxylic acids and $C_4$–$C_6$ monoolefinic dicarboxylic acids.

3. A composition according to claim 1 wherein the polymer comprises on a monomer weight basis (i) from about 20% to about 40% of monoolefinic monocarboxylic acid, (ii) from about 20% to about 40% of monoolefinic dicarboxylic acid, and (iii) from about 20% to about 45% of nonionic spacer selected from $C_1$–$C_6$ alkyl and hydroxyalkyl esters of $C_3$–$C_{10}$ monoolefinic monocarboxylic acids and $C_4$–$C_6$ monoolefinic dicarboxylic acids.

4. A composition according to claim 2 wherein the nonionic spacer is selected from $C_2$–$C_6$ hydroxyalkyl esters of $C_3$–$C_{10}$ monoolefinic monocarboxylic acids and $C_4$–$C_6$ monoolefinic dicarboxylic acids.

5. A composition according to claim 4 wherein the monocarboxylic acid is selected from acrylic acid, methacrylic acid and mixtures thereof, the dicarboxylic acid is selected from maleic acid, itaconic acid and mixtures thereof and the nonionic spacer is selected from hydroxypropyl(meth)acrylate, hydroxyethyl(meth)acrylate and butanediolmono(meth)acrylate.

6. A composition according to claim 1 wherein the polymer comprises on a monomer weight basis:

(i) from about 20% to about 60% of monoolefinic monocarboxylic acid, (ii) from about 20% to about 60% of monoolefinic dicarboxylic acid, and (iii) from about 1% to about 40% of nonionic spacer selected from $C_2$–$C_6$ monoolefinic alcohols and $C_1$–$C_6$ alkyl and hydroxyalkyl esters thereof.

7. A composition according to claim 1 wherein the polymer comprises on a monomer weight basis:

(i) from about 30% to about 50% of monoolefinic monocarboxylic acid, (ii) from about 30% to about 50% of monoolefinic dicarboxylic acid, and (iii) from about 2% to about 25% of nonionic spacer selected from $C_2$–$C_6$ monoolefinic alcohols and $C_1$–$C_6$ alkyl and hydroxyalkyl esters thereof.

8. A composition according to claim 6 wherein the monocarboxylic acid is selected from acrylic acid, methacrylic acid and mixtures thereof, the dicarboxylic acid is selected from maleic acid, itaconic acid and mixtures thereof and the nonionic spacer is vinyl acetate or vinyl alcohol.

9. A composition according to any of claim 5 comprising from about 6% to about 25% by weight of the water-insoluble aluminosilicate ion exchange material and from about 0.5% to 10% of the polycarboxylate polymer.

10. A composition according to any of claim 8 comprising from about 6% to about 25% by weight of the water-insoluble aluminosilicate ion exchange material and from about 0.5% to 10% of the polycarboxylate polymer.

11. A composition according to any of claim 1 comprising from about 2% to about 18% of a phosphate builder, from about 1% to about 10% of an alkali metal silicate, from about 5% to about 35% of inorganic or organic peroxy bleaching agent, from 0% to 10% of organic peroxyacid bleach precursor, and a heavy metal scavenging agent.

12. A composition according to claim 11 comprising from about 8% to about 14% of the phosphate builder and from about 0.5% to about 5% of organic peroxyacid bleach precursor.

13. A composition according to claim 12 additionally comprising from 0.1% to 5% of a homo or bi-polycarboxylate polymer comprising on a monomer weight basis from about 25% to 100% of a $C_3$–$C_{10}$ monoolefinic monocarboxylic acid and/or a $C_4$–$C_6$ monoolefinic dicarboxylic acid.

* * * * *